US007476838B2

(12) United States Patent
Sasaki

(10) Patent No.: US 7,476,838 B2
(45) Date of Patent: Jan. 13, 2009

(54) PHOTOELECTRIC IMAGING SENSOR AND TWO-DIMENSIONAL OUTPUT ELECTRODE ARRAY USED THEREIN

(75) Inventor: Makoto Sasaki, Misato (JP)

(73) Assignee: The University of Tokyo, Bunkyo-ku (JP)

( * ) Notice: Subject to any disclaimer, the term of this patent is extended or adjusted under 35 U.S.C. 154(b) by 0 days.

(21) Appl. No.: 10/591,938

(22) PCT Filed: Mar. 10, 2005

(86) PCT No.: PCT/JP2005/004213

§ 371 (c)(1),
(2), (4) Date: Jan. 30, 2007

(87) PCT Pub. No.: WO2005/086202

PCT Pub. Date: Sep. 15, 2005

(65) Prior Publication Data

US 2007/0205353 A1 Sep. 6, 2007

(30) Foreign Application Priority Data

Mar. 10, 2004 (JP) ..... 2004-066955

(51) Int. Cl.
*H01J 31/50* (2006.01)
*H01J 43/30* (2006.01)

(52) U.S. Cl. ..... 250/214 VT; 250/207; 313/523

(58) Field of Classification Search ..... 250/214.1, 250/214 R, 214 VT, 207; 313/523, 528, 531, 313/532, 542
See application file for complete search history.

(56) References Cited

U.S. PATENT DOCUMENTS

| | | | | |
|---|---|---|---|---|
| 3,668,388 | A * | 6/1972 | Fisher et al. | 313/531 |
| 2003/0010942 | A1 * | 1/2003 | Kuwabara | 250/580 |
| 2004/0069932 | A1 * | 4/2004 | Kato et al. | 250/214 VT |

FOREIGN PATENT DOCUMENTS

| | | | |
|---|---|---|---|
| JP | 63-031281 | A1 | 2/1988 |
| JP | 03-180725 | A1 | 8/1991 |
| JP | 05-072344 | A1 | 3/1993 |
| JP | 06-028997 | A1 | 2/1994 |
| JP | 07336495 | * | 6/1994 |
| JP | 2003-069179 | A1 | 3/2003 |
| JP | 2003-069187 | A1 | 3/2003 |
| JP | 2004-279200 | A1 | 10/2004 |

* cited by examiner

*Primary Examiner*—Thanh X Luu
*Assistant Examiner*—Francis M Legasse, Jr.
(74) *Attorney, Agent, or Firm*—Burr & Brown

(57) ABSTRACT

A photo cathode converts an incident light into photoelectrons. A photomultiplier kept vacuum inside thereof, amplifies photoelectrons converted by the photo cathode. Photoelectrons intensified by the photomultiplier arrives at an output electrode array, and a current signal produced by the photoelectrons arriving at the output electrode array is directly read outside the photomultiplier via metal bulbs or anisotropic conductive rubber.

4 Claims, 4 Drawing Sheets

PHOTOELECTRIC IMAGING SENSOR AND TWO-DIMENSIONAL OUTPUT ELECTRODE ARRAY USED THEREIN

FIELD OF THE INVENTION

The present invention relates to a photoelectric imaging sensor and output electrode array used therein which are utilized in a real-time observation of a very rare phenomenon and so on in fields of medicine, space science, protection against disasters and defense.

BACKGROUND OF THE INVENTION

In order to improve the sensitivity and the resolution of the photoelectric imaging sensor, there is a proposed photoelectric imaging sensor comprising: a photo cathode converting an incident light into photoelectrons; a photomultiplier, kept vacuum inside thereof, intensifying photoelectrons converted by the photo cathode; a plurality of output electrodes at which photoelectrons intensified by the photomultiplier arrives; and a plurality of signal pick-up electrodes corresponding to these output electrodes. In the proposed photoelectric imaging sensor, an integrated circuit is incorporated into the signal pick-up electrode and each output electrode is insulated from the corresponding signal pick-up electrode. (For example, Patent Document 1)

Patent Document 1: Japanese Patent Application Laid-Open No. 28,997/94

SUMMARY OF THE INVENTION

In such a photoelectric imaging sensor, as the signal pick-up electrode, that is, the integrated circuit is arranged in the vacuum space of the photomultiplier, it is necessary to output image data generated by the integrated circuit from the vacuum space of the photomultiplier to external. Such a necessity is not preferable in view of a fast optical detection. Also, it is difficult to maintain the vacuum space of the photomultiplier because outgas is generated from the integrated circuit. Moreover, it is necessary to take measures against heating because the integrated circuit is heated in the vacuum space of the photomultiplier. Therefore, the photoelectric imaging sensor becomes expensive.

The object of the present invention is to provide a photoelectric imaging sensor and an output electrode array used therein which are capable of performing a fast optical detection while keeping a high sensitivity and a high resolution, and which are easy to keep a vacuum therein and have an inexpensive construction.

According to one aspect of the present invention, there is provided a photoelectric imaging sensor comprising:

a photo cathode converting an incident light into photoelectrons;

a photomultiplier, kept vacuum inside thereof, intensifying photoelectrons converted by the photo cathode;

an output electrode array at which photoelectrons intensified by the photomultiplier arrives; and connecting means for electrically connecting the output electrode array to pick-up electrodes arranged outside the photomultiplier.

According to another aspect of the present invention, there is provided an output electrode array for a photoelectric imaging sensor, having a plurality of plate electrodes of an array arrangement so as to neighbor to each other at vertical direction, and support electrodes electrically connecting the plate electrodes neighboring to each other at vertical direction together.

According to the photoelectric imaging sensor of the invention, as the pick-up electrode arranged outside the photomultiplier is electrically connected to the output electrode array, it is possible to directly read a current signal produced by the photoelectrons arrived at the output electrode array outside the photomultiplier. As a result, it is possible to perform a fast optical detection while keeping a high sensitivity and a high resolution. Also, as the signal pick-up electrode and the integrated circuit incorporated therein are arranged outside the photomultiplier, it is not necessary to take measures against heating and it becomes easy to replace the integrated circuit. As a result, it is possible to construct an inexpensive photoelectric imaging sensor. Moreover, as the signal pick-up electrode and the integrated circuit incorporated therein are arranged outside the photomultiplier, the outgas from the integrated circuit does not affect on the keeping vacuum inside the photomultiplier. As a result, it becomes easy to keep vacuum inside the photomultiplier.

Preferably, the output electrode array has a plurality of plate electrodes of an array arrangement so as to neighbor to each other at vertical direction, and support electrodes electrically connecting the plate electrodes neighboring to each other at vertical direction together.

Anisotropic conductive rubber as the connecting means is preferable in view of an inexpensive construction because it is not necessary to have relatively high accuracy of the alignment between the output electrode array and the signal pick-up electrode. Metal bulbs as the connecting means is preferable in view of high resolution because it is possible to make a pitch between the output electrode array and the signal pick-up electrode relatively short. (For example, 20 μm)

According to the output electrode array for the photoelectric imaging sensor of the present invention, it is possible to provide a photoelectric imaging sensor which is capable of performing a fast optical detection while keeping a high sensitivity and a high resolution, and which is easy to keep a vacuum therein and has an inexpensive construction.

DETAILED DESCRIPTION OF THE INVENTION

The embodiments of the photoelectric imaging sensor and the output electrode array used therein according to the present invention will be described with reference to the drawings.

Figure 1:
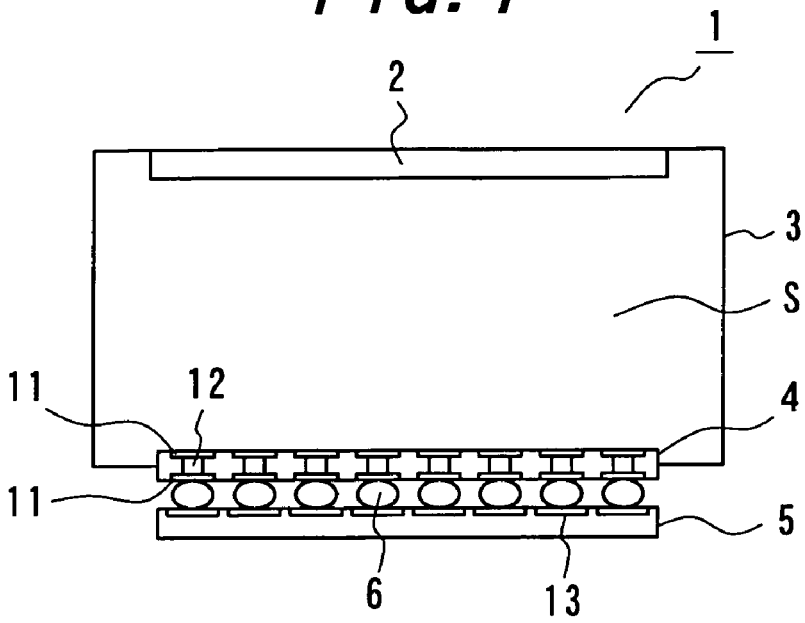
FIG. 1 is a schematic diagram of the embodiment of the photoelectric imaging sensor according to the present invention.
Figure 2:
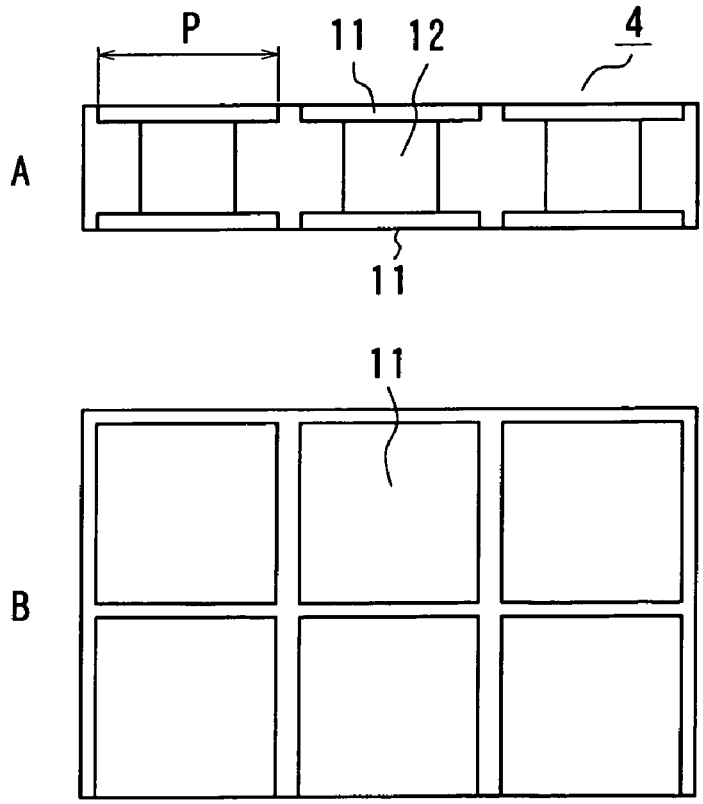
FIG. 2 is a schematic diagram of the output electrode array of the photoelectric imaging sensor shown in FIG. 1.

FIG. 1 is a schematic diagram of the embodiment of the photoelectric imaging sensor according to the present invention, and FIG. 2 is a schematic diagram of the output electrode array of the photoelectric imaging sensor shown in FIG. 1. The photoelectric imaging sensor 1 shown in FIG. 1 comprises a photo cathode 2, a photomultiplier 3, output electrode array 4, and metal bulbs 6 electrically connecting to the output electrode array 4 and a pick-up electrode array 5.

In the embodiment, the photo cathode 2 is composed of a plate electrode provided on one main face of the photomultiplier 3. A space S between the photo cathode 2 and the output electrode array 4 in the photomultiplier 3 is kept vacuum. On the other main face of the photomultiplier 3, the output electrode array 4 is opposite to the photo cathode 2. As shown in FIG. 2, the output electrode array 4 has a plurality of plate electrodes 11 of an array arrangement so as to neighbor to each other at vertical direction, and support electrodes 12 electrically connecting the plate electrodes 11 neighboring to each other at vertical direction together. The plate electrodes 11 on the upper side thereof are situated in the space S kept vacuum inside the photomultiplier 3, and the plate electrodes 11 on the lower side thereof is situated outside the photomultiplier 3, that is, in the air.

The pick-up electrode array 5 is opposite to the output electrode array 4 and is arranged so that a plurality of plate electrodes 13 neighbors to each other at the side opposite to the output electrode array 4. There is a one-to-one correspondence of the plate electrodes 11 of the output electrode array 4 and the plate electrodes 13 of the pick-up electrode array 5 to each other, and the plate electrodes 11 connects to the plate electrodes 13 through the metal bulbs 6. Also, certain integrated circuits not shown are incorporated into the pick-up electrode array 5.

It is possible to make a 128×128 arrangement of the plate electrodes 11 and 13, for example. Each pitch p may be 0.01 to 0.02 mm. The distance between the output electrode array 4 and the pick-up electrode array 5 may be not more than 20 μm, for example, by making the metal bulb 6 minute.

The operation of the embodiment will be explained. Light incident on the photo cathode 2 is converted into photoelectrons. The photoelectrons converted by the photo cathode 2 are intensified by the photomultiplier 3. The photoelectrons intensified by the photomultiplier 3 arrive at the output electrode array 4. A current signal produced by the photoelectrons arriving at the output electrode array 4 is directly read outside the photomultiplier 3. That is, the current signal is output from the plate electrodes 11 at the upper side of the output electrode array 4 to the plate electrodes 11 at the lower side of the output electrode array 4 though the support electrodes 12.

The current signal output from the plate electrodes 11 at the lower side of the output electrode array 4 is input to the pick-up electrode array 5 through the metal bulbs 6. The current signal input to the pick-up electrode array 5 is processed by the integrated circuits (not shown) incorporated into the pick-up electrode array 5, and is output to external as an image data.

In order to perform a fast optical detection while maintaining a high sensitivity and a high resolution, two-dimensional semiconductor sensors, control circuit and so on are sealed into the vacuum space, the current distribution is directly read in the vacuum space and the current distribution is acquired to external as one or a few electrical signal lines in the prior art. However, a cause of degrading the vacuum degree such as outgas is introduced because a complex structure is sealed into the vacuum space. Further, the way of cooling to restrict heating in the vacuum space and the specification imposing on the circuit operating in the vacuum space at high temperature highly contribute to high cost of the sensor as a whole. On the other hand, according to the embodiment, such disadvantages are overcome.

Once the semiconductor sensor is sealed into the vacuum space, it is impossible to replace the semiconductor sensor and thus it is impossible to obtain the convenience such as the diversion and the flexibility. According to the embodiment, as the acquisition of the two-dimensional current distribution is independent on the process of the reading circuit, there is a degree of freedom in combination. Further, the embodiment makes the flexibility high and highly contributes to the productivity and the cost reduction.

Figure 3:
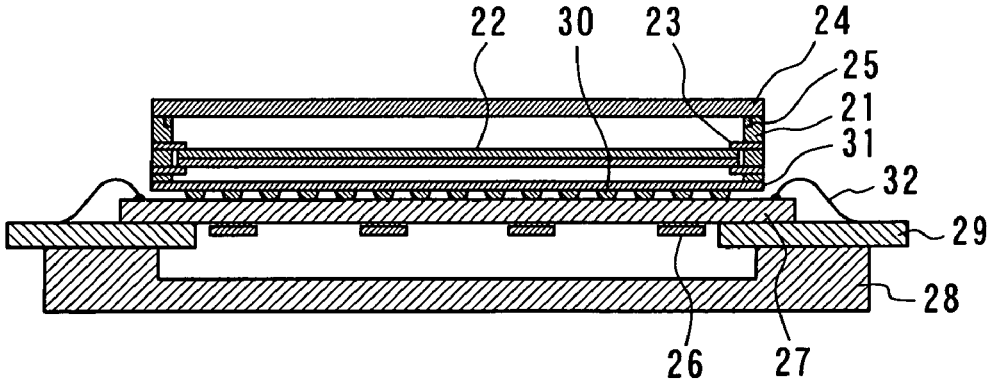
FIG. 3 is a diagram of the embodiment of the photoelectric imaging sensor with a micro channel type of the photomultiplier according to the present invention.

FIG. 3 is a diagram of the embodiment of the photoelectric imaging sensor with a micro channel type of the photomultiplier according to the present invention. According to the embodiment, double micro channel plates 22 are supported by a drag 23 in a vacuum space of a photomultiplier 21, and indium seal 25 is provided between the photomultiplier 21 and a photo cathode 24.

A pick-up electrode array 27 arranged outside the photomultiplier 21 and incorporating an integrated circuit 26 is supported by a print circuit board 29 arranged on a backup plate 28 and is electrically connected to an output electrode array 31 through metal bulbs 30. An image data generated by the integrated circuit 26 is output through an Au wire 32.

In case of using the micro channel type of the photomultiplier, electrons produced by photoelectric converting micro light at photon level with the photo cathode 24 are multiplied by the micro channel plates 22 arranged in the vacuum space up to high multiplication factor (~$10^7$ times) while keeping high resolution (~6 μm), and arrives at output electrode array 31 as a electron beam. When the output electrode array 31 is densely arranged such as in the embodiment, it is possible to obtain the two-dimensional current distribution with high resolution from the back face of the output electrode array 31, whose resolution reaches the limiting resolution of the multiplying process in the micro channel plate 22 in principle. The limiting resolution of the micro channel plate 22 is equal to that of the two-dimensional semiconductor sensor such as a current CCD. That is, it is possible to easily obtain the resolution of the two-dimensional semiconductor sensor such as the CCD while maintaining the current reading with a fast detection rate (not more than ns order), high gain and high sensitivity (~$10^7$) which are advantages of a general photomultiplier.

Figure 4:
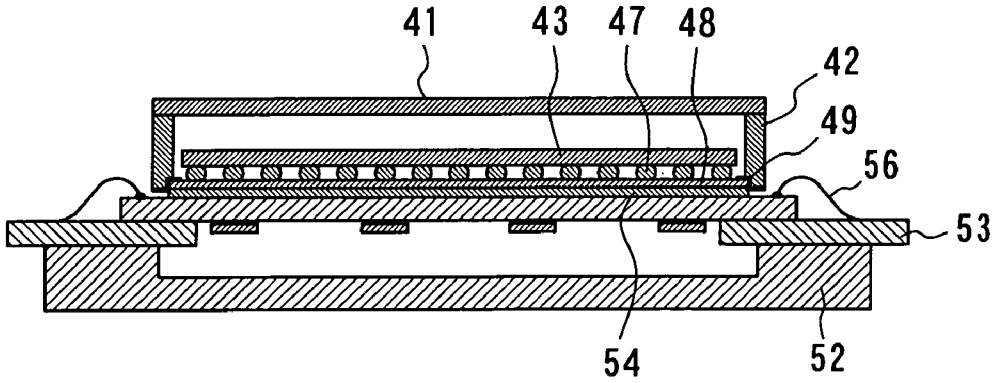
FIG. 4 is a diagram of the embodiment of the photoelectric imaging sensor with a hybrid type of the photomultiplier according to the present invention.
Figure 5:
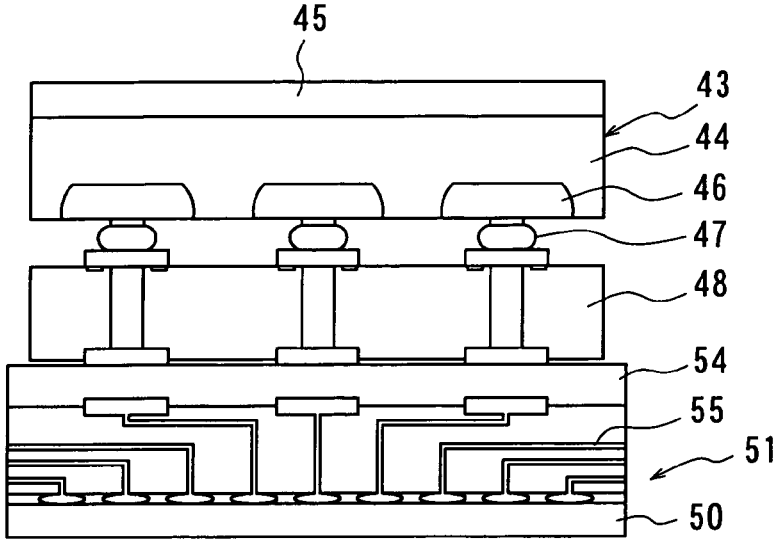
FIG. 5 is a partial enlarged diagram of the photoelectric imaging sensor shown in FIG. 4.

FIG. 4 is a diagram of the embodiment of the photoelectric imaging sensor with a hybrid type of the photomultiplier according to the present invention and FIG. 5 is a partial enlarged diagram thereof. In the embodiment, a photo cathode 41 is arranged on a main surface of a photomultiplier 42 and a multi-pixel photo diode 43 is arranged in a vacuum space of the photomultiplier 42.

The multi-pixel photo diode 43 has a detection substrate 44 such as a silicon substrate, an n type of diffusion region 45, and a p type of injection region 46. The multi-pixel photo diode 43 electrically connects to an output electrode array 48 though metal bulbs 47. The output electrode array 48 has the same structure as shown in FIG. 2. An indium seal 49 is provided between the photomultiplier 42 and the photo cathode 41.

A pick-up electrode array 51 arranged outside the photomultiplier 42 and incorporating an integrated circuit 50 is supported by a print circuit board 53 arranged on a backup plate 52, and electrically connects to the output electrode array 48 through anisotropic conductive rubber 54. An image data generated by the integrated circuit 50 is output to external through wiring 55 and an Au wire 56.

In case of using the hybrid type of the photomultiplier, high electrons produced by photoelectric converting micro light at photon level with the photo cathode 41 is accelerated and irradiated on the detection substrate 44 with high electric field (~10 kV), the energy of the electrons is converted into a plurality of electron-hole pairs with high conversion rate (for example, 3.4 electron voltage/electron-hole pair), electrons or holes are extracted to a back surface of the detection substrate 44 by applying bias electric field (~100V), and thus it is possible to obtain a current with high multiplication factor. (~$10^4$ times) It is also possible to obtain a current with higher multiplication factor ($10^7$ times) by utilizing avalanche multiplication of PN junction.

The mobility of the electron in the silicon semiconductor is 1800 $cm^2/(V \cdot s)$, the distance required to convert all energy produced by the incident accelerated electrons into the electron-hole pairs is several μm, there is only several μm of movement in a two-dimensional position information, and the time required in the multiplication process thereof is about 0.1 ns. That is, it is possible to read a fast and minute current distribution by utilizing a multiplication process in the semiconductor.

According to the embodiment, after the multiplication process of an accelerated photoelectron in the detection substrate 44, the current distribution is read from the output electrode array 48 to external as a two-dimensional image while keeping high resolution. (several μm) In this time, the output electrode array 48 arranging metal plate-metal column-metal plate densely connects to the p type injection region 46 through the metal bulbs 47 and the current multiplied at the detection substrate 44 in the vacuum space is conducted to external air. That is, it is possible to easily obtain the resolution of the two-dimensional semiconductor sensor such as the CCD while maintaining the current reading with a fast detection rate (not more than ns order), high gain and high sensitivity (~$10^7$) which are advantages of a general photomultiplier.

Figure 6:
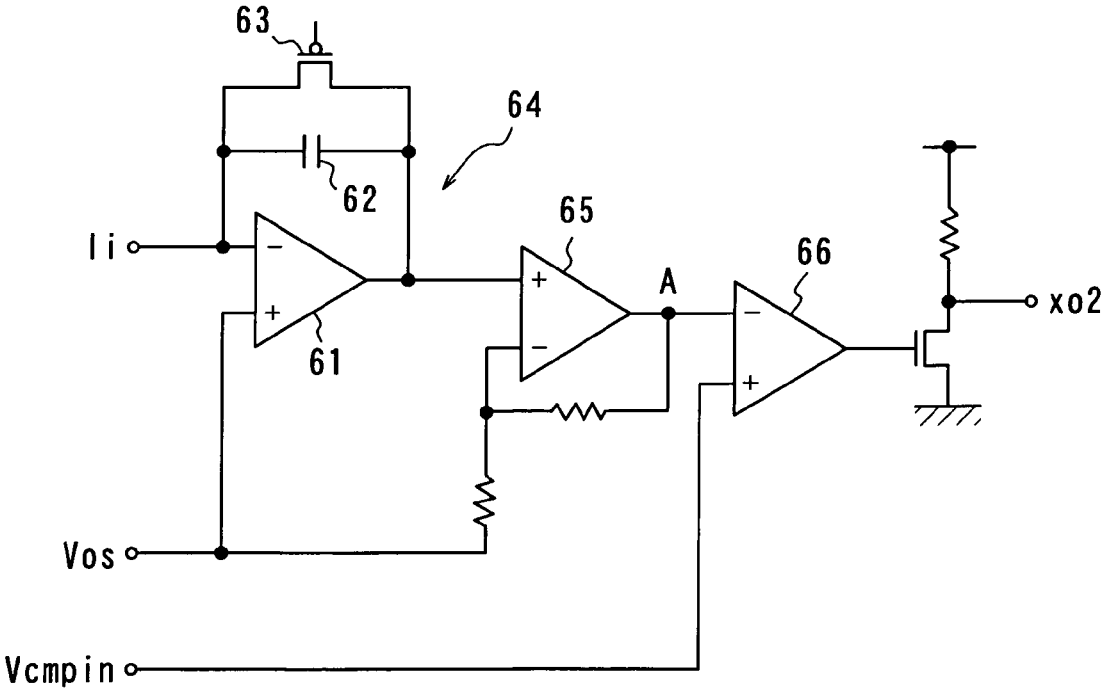
FIG. 6 is a drawing showing one example of a circuit processing a current picked up from the output electrode array of the photoelectric imaging sensor according to the present invention into external air.
Figure 7:
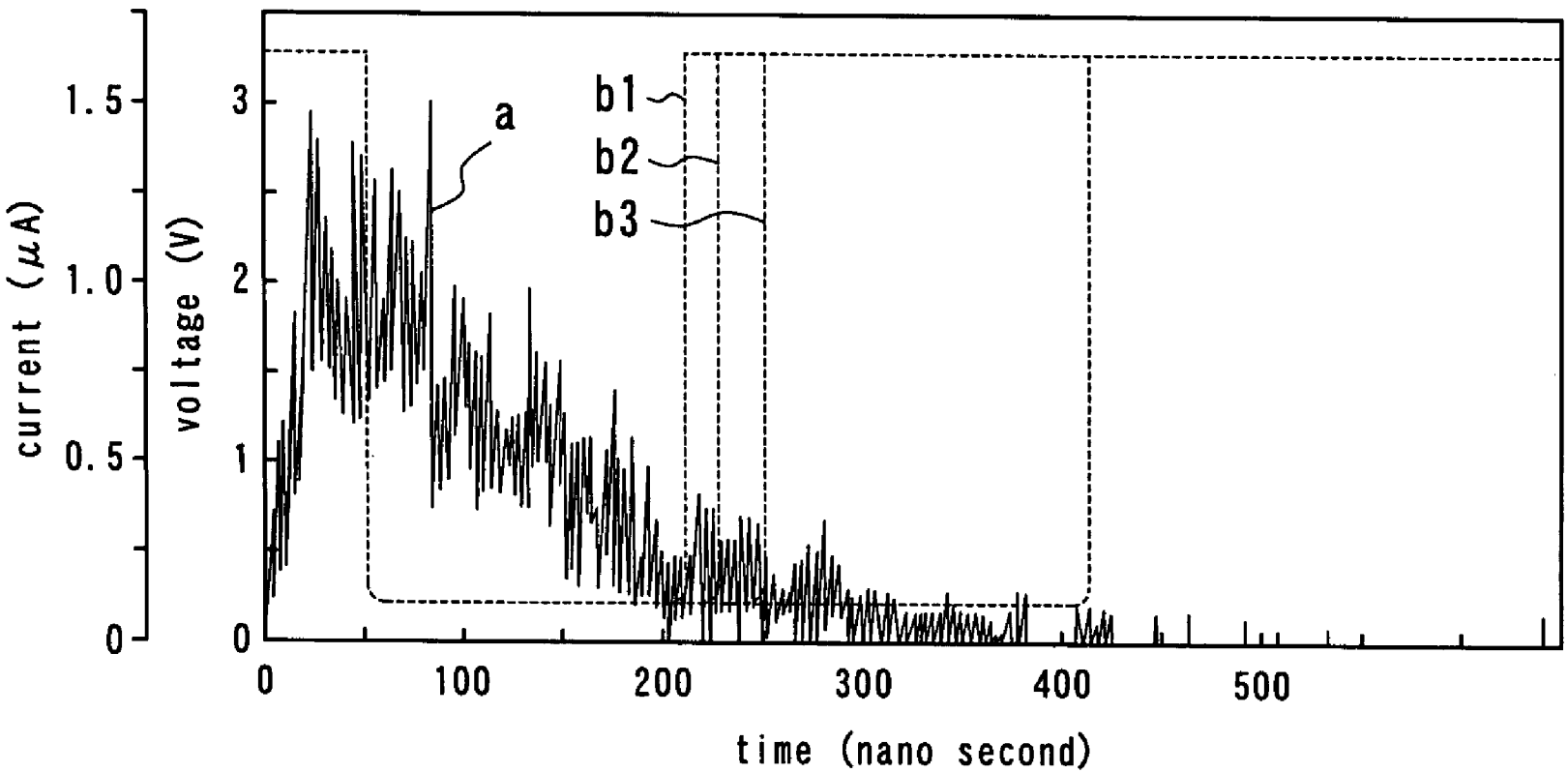
FIG. 7 is a diagram explaining a process of the circuit in FIG. 6.

FIG. 6 is a drawing showing one example of a circuit processing a current picked up from the output electrode array of the photoelectric imaging sensor according to the present invention into external air, and FIG. 7 is a diagram explaining a process of the circuit in FIG. 6. In this case, the photoelectric imaging sensor with a structure shown in FIG. 3 is used, and the output electrode array and the pick-up electrode array with an array arrangement of 128×128 plates electrodes are used.

The circuit shown in FIG. 6 is a discriminator circuit judging whether a current acquired from one electrode of the output electrode array is more significant than a background noise or not. In this case, unprocessed current Ii acquired from the electrode and input to the discriminator circuit (In FIG. 7, the current Ii is represented by a current wave a.) is shaped by a band-pass filter 64 (composed of an op-amp 61, a capacitor 62 and a FET 63. The capacitor 62 and the FET 63 are parallel to the op-amp 61.) in a first stage and an amplifier 65 in a second stage, and thus voltage signal waves b1, b2, b3 (FIG. 7) are obtained at point A. The voltage signal waves b1, b2, b3 correspond to those changing resistance value effectively by changing the voltage applied to a gate of the FET 63 among 0.4 V, 0.5 V and 0.6 V. A comparator 66 in a final stage has a threshold value which is a reference voltage Vcmpin (For example, 1.6 V) from external, discriminates the wave height when shaped voltage wave exceeds the threshold value, and output not zero but negative voltage pulse xo2.

It is possible to control the pulse width within a short time width from several ten ns to 100 ns corresponding to the time when the shaped voltage wave exceeds the threshold value. Wave height discriminating output signal is obtained from each electrode. When an instant two-dimensional pattern of the phenomenon of micro and fast light incident on the photoelectric imaging sensor according to the present invention is judged by a two-dimensional distribution of the wave height discriminating output signal, it is possible to perform a significant and reliable real-time discrimination of the phenomenon of light to be obtained from the background noise, as shown in FIG. 7.

While the present invention has been described above with reference to certain preferred embodiments, it should be noted that they were presented by way of examples only and various changes and/or modifications may be made without departing from the scope of the invention.

For example, the photo cathode has other shape than plate in the embodiment. Also, the output electrode array has other structure than that shown in FIG. 2. Moreover, the connecting means may be realized by other than anisotropic conductive rubber or metal bulbs.

INDUSTRIAL APPLICABILITY

The present invention is applied to the improvement of the detection sensitivity and fast automatic real-time judgment in fields of micro electric signal test, fast image recognition, diagnosis, protection against disasters, defense and so on, for example. The present invention may be preferably utilized in a micro light automatic measuring instrument, a very fast imaging device, a real-time watching device, an automatic track recognition device, a real-time medical diagnostic device, a very rare phenomenon detection device and so on.

The invention claimed is:

1. A photoelectric imaging sensor comprising:

a photo cathode converting an incident light into photoelectrons;

a photomultiplier, kept vacuum inside thereof, intensifying photoelectrons converted by said photo cathode;

an two-dimensional output electrode array arranged in a plane comprising plate electrodes at which photoelectrons intensified by said photomultiplier arrive; and connecting means for electrically connecting said output electrode array to pick-up electrodes arranged outside said photomultiplier, wherein said output electrodes array comprises:

a plurality of plate electrodes in an array arrangment at a first side of the output electrode array;

another plurality of plate electrodes in an array arrangment at a second side of the output electrode array, each of the plate electrodes corresponding to one of the plate electrodes at the first side of the output electrode array; and support electrodes electrically connecting each of the corresponding plate electrodes at the first side and at the second side.

2. The photoelectric imaging sensor according to claim 1, wherein said connecting means are anisotropic conductive rubber or metal bulbs.

3. The photoelectric imaging sensor according to claim 1, wherein said connecting means are anisotropic conductive rubber or metal bulbs.

4. An output electrode array for a photoelectric imaging sensor using a photomultiplier, comprising:

a plurality of plate electrodes in an array arrangement at a first side of the output electrode array;

another plurality of plate electrodes in an array arrangement at a second side of the output electrode array, each of the plate electrodes corresponding to one of the plate electrodes at the first side of the output electrode array; and support electrodes electrically connecting each of the corresponding plate electrodes at the first side and at the second side;

a photocathode converting an incident light into photoelectrons, and a photomultiplier, kept vacuum inside thereof, intensifying photoelectrons converted by said photo cathode, wherein the first side of the output electrode array is facing inside of the photomultiplier and the second side of the output electrode array is facing outside of the photomultiplier.

* * * * *